US006136056A

United States Patent [19]

Krehan

[11] Patent Number: 6,136,056

[45] Date of Patent: Oct. 24, 2000

[54] CONNECTION MEMBER FOR A FILTER BAG FOR VACUUM CLEANING EQUIPMENT

[75] Inventor: Herbert Krehan, Fürth, Germany

[73] Assignee: Branofilter GmbH, Dietenhofen, Germany

[21] Appl. No.: 09/249,595

[22] Filed: Feb. 12, 1999

[30] Foreign Application Priority Data

Mar. 5, 1998 [DE] Germany ..... 298 03 839 U

[51] Int. Cl.[7] ..... B01D 46/02

[52] U.S. Cl. ..... 55/367; 55/369; 55/377; 55/378; 55/DIG. 2

[58] Field of Search ..... 55/367, 369, 376, 55/377, 378, DIG. 2, 361

[56] References Cited

U.S. PATENT DOCUMENTS

| | | | |
|---|---|---|---|
| 5,468,272 | 11/1995 | Schmierer . | |
| 5,472,460 | 12/1995 | Schmierer . | |
| 5,472,465 | 12/1995 | Schmierer . | |
| 5,772,712 | 6/1998 | Perea et al. | 55/DIG. 2 |
| 5,935,280 | 8/1999 | Lee | 55/DIG. 2 |

FOREIGN PATENT DOCUMENTS

| | | | |
|---|---|---|---|
| 2407478 | 8/1974 | Germany | 55/DIG. 2 |
| 43 42 267 | 6/1994 | Germany . | |
| 295 11 029 U | 10/1995 | Germany . | |

*Primary Examiner*—David A. Simmons
*Assistant Examiner*—Minh-Chau T. Pham
*Attorney, Agent, or Firm*—Flynn, Thiel, Boutell & Tanis, P.C.

[57] ABSTRACT

A connection member for a filter bag for vacuum cleaning equipment. The member has a base with two superposed base layers of stiff material which together define a first passage opening. A slide element, located between the two layers of the base, has a second passage opening therein which in an initial position is aligned with the first passage opening. By pulling on a handle portion of the slide element, the first passage opening is closed by a closure element that is connected to the slide element. The closure element, in the initial position, is in the form of a strand of incompletely cured plastic material. Upon application of a tensile force, the strand is adapted to plastically deform. The plastic material furthermore adheres on the one side to the slide element and on an opposed side to the base. Upon movement of the slide element into the closed position, the material is adapted to stretch in the longitudinal direction and to be drawn out as a diaphragm closing the first passage opening.

19 Claims, 2 Drawing Sheets

CONNECTION MEMBER FOR A FILTER BAG FOR VACUUM CLEANING EQUIPMENT

BACKGROUND OF THE INVENTION

The invention relates to a connection member of a filter bag for vacuum cleaning equipment, comprising an essentially tabular base with two superposed base layers of stiff material, more particularly board, which together define a first passage opening extending through both base layers. There is a slide element having a second passage opening therein and guided between said layers for motion in its longitudinal direction. The slide element having on one side of the second passage opening a handle portion projecting from said base and on the other side of the second passage opening is drivingly connected with a closure means in such a manner that the slide element may be moved from an initial position, in which the second passage opening is located at the position of the first passage opening, by pulling the handle portion into a closed position, the closure member being entrained, in which the closure means closes said first passage opening.

Both in the case of household vacuum cleaners and also in the case of larger, industrial vacuum cleaners filter bags are employed for collecting the dust sucked up. The term vacuum cleaner bags also including large filter bags or sacks. In this respect a suction flow is produced by means of a fan, which draws the dust or the like into a suction duct, suction hose or the like, whence it is moved through a dust entry opening of the filter bag into the bag. The dust contained in the aspirated air is retained by the wall of the filter bag, whereas the air flow freed of dust passes through the filter bag wall and is then discharged into the surroundings. When the filter bag is full it is removed and may be thrown away.

The mounting in the filter bag in vacuum cleaning equipment is performed using the connection member attached to the filter bag adjacent to its inlet opening. The member being so arranged that the passage opening formed in the layers of the base is aligned with the inlet opening in the filter bag and the dust laden air may enter.

When the full filter bag is removed from the vacuum cleaning equipment, it is possible for the passage opening of the connection member and hence furthermore the passage opening in the filter bag to be closed with the aid of the slide element so that no dust may escape from the bag into the surroundings.

THE PRIOR ART.

In the case of known connection members of this type (see for instance the German patent publication U 29,511,029) the closure means is formed by an integral extension of the slide element and projects on the side, which is opposite to the handle portion, from the base. This projecting portion of the closure means may interfere with manipulation, more particularly on insertion of the connection member in the respective receiving socket in the vacuum cleaner in question.

SUMMARY OF THE INVENTION

One object of the invention is to therefore provide a filter bag connection member which has a compact structure.

In order to achieve the above and other objects appearing from the present specification, claims and comprises plastic material in the form of a strand extending transversely in the initial state, such plastic material not being fully cured and adapted to plastically deform on the application of a tensile force. The plastic material between the layers of the base furthermore adhere to the slide element and on the other hand on the base and on movement of the slide element into the closed position such material is adapted to stretch in the longitudinal direction and to be drawn out as a diaphragm closing the first passage opening.

This means that the closure means no longer ends outside the base and is unattached, but within the base and in this respect is not only attached on the one hand to the slide element but furthermore on the base as well. Despite the arrangement of the closure means completely within the base, it is possible for the closure means to fulfill its closing function, something which is rendered possible by its extensible design. In the initial position the closure means consequently is comparatively short in length, and it becomes longer on movement into the closed position owing to the tensile force applied by the slide element.

It is preferred for the slide element to include stiff material, more particularly board, in its structure.

In accordance with a further preferred development of the invention in the closed position the slide element abuts against an abutment arranged on the base. Such abutment prevents the slide element from being drawn out too far, something which would tear the closure diaphragm.

Further advantageous developments and convenient forms of the invention will be understood from the following detailed descriptive disclosure of one embodiment thereof in conjunction with the accompanying drawings.

LIST OF THE VIEWS OF THE FIGURES.

DETAILED ACCOUNT OF THE INVENTION.

Figure 3:
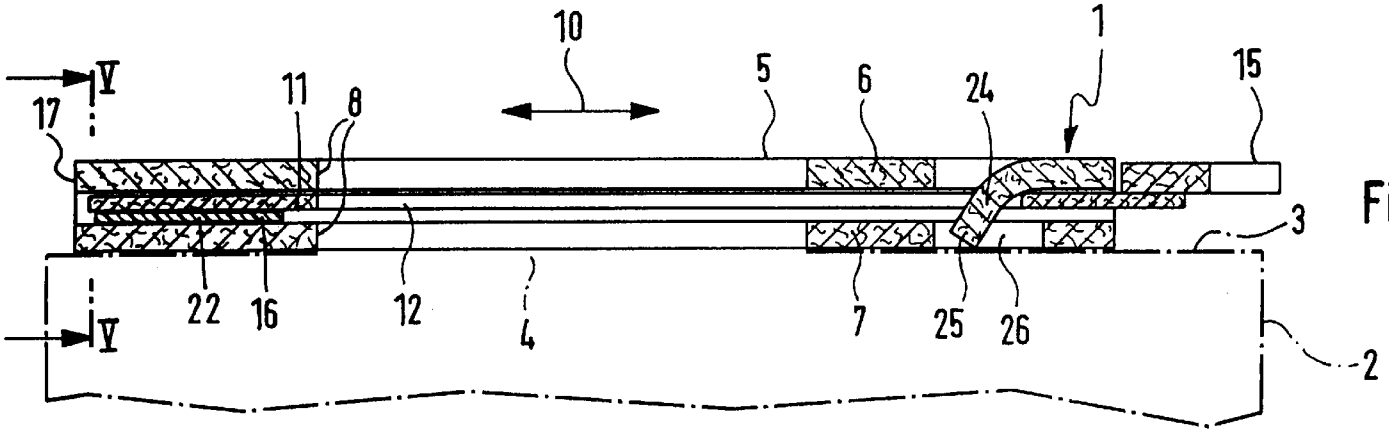
FIG. 3 shows the arrangement in accordance with FIG. 1 in a longitudinal section taken on the line III—III, the different parts of the connection member being shown thicker than in reality and furthermore the filter bag is indicated in chained lines.

The connection member 1 is intended for a filter bag 2 as indicated partially in chained lines only in FIG. 3, whose front wall 3 has an inlet opening 4, adjacent to which to the outside the connection member 1 is secured to the front wall 3, such attachment generally being by adhesive.

The filter bag 2 comprises air permeable filter material (paper, non-woven material or the like) and is mounted in an item of vacuum cleaning equipment. In this respect the connection member 1 serves for the production of the joint between the filter bag and a socket on the equipment by fitting into same, the equipment normally having a connection spigot on it here, such spigot being plugged through the connection member into the inlet opening 4 of the front wall 3 of the bag.

The connection member 1 possesses an essentially tabular or plate-like configuration. Its perimeter may be rectangular or in some other convenient design so that there is an adaptation to the respective type of vacuum cleaning equipment and, respectively, the socket for holding the connection member.

The connection member 1 has an essentially tabular base 5, which comprises two superposed base layers or plies 6 and 7, which are fabricated of stiff material, more especially board. One of the two base layers, the bottom base layer 7, faces the front wall 3 of the filter bag and is bonded to same. The top base layer 6, spaced away from the filter bag, is substantially aligned above the bottom layer 7.

The base 5 furthermore has a passage opening 8, which serves for slipping the connection member 1 onto the connection spigot on the equipment and in the present embodiment of the invention is in the form of a suitable hole through the two base layers 6 and 7. The passage opening 8 is arranged in alignment with the inlet opening 4 in the front wall 3 of the filter bag. To obtain a better seal for the connection spigot of the equipment it is possible for a sealing diaphragm (not illustrated) with a hole therein can be attached on the top side, facing the top base layer 6, of the bottom base layer 7 at the passage opening 8 so as to project in an annular manner into the passage opening 8 and snugly engage the connection spigot, when the base is slipped onto it.

The connection member 1 furthermore comprises a slide element 11 running between the two base layers 6 and 7 for sliding motion in its longitudinal direction 10, a passage opening 12 being formed in the element 11 for alignment with the passage opening 8 in the base 5. The two layers 6 and 7 are bonded to one another on either side of the slide element 11 at the strip-like regions 13 and 14.

Figure 1:
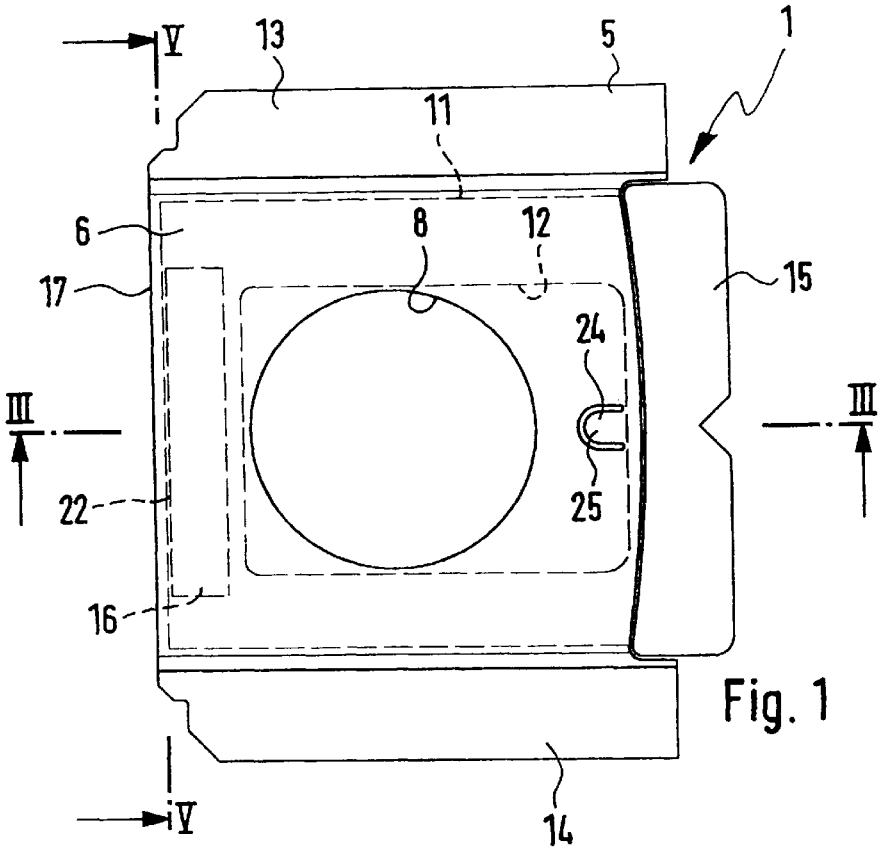
FIG. 1 shows a connection member of the invention in plan view looking toward its top side facing away from the filter bag, which is not illustrated, the slide element being located in the initial position so that the passage opening of the base is open.
Figure 2:
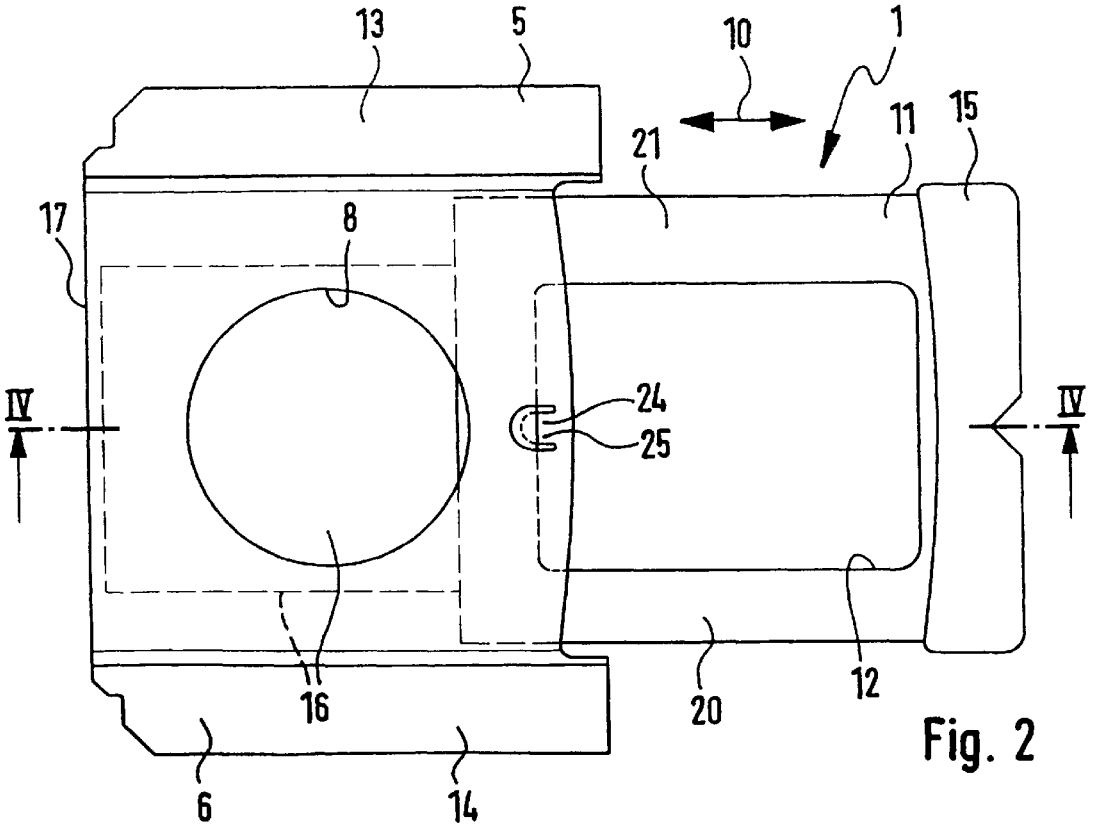
FIG. 2 shows the connection member of FIG. 1 in the same plan view, the closure slide being pulled into the closed position together with the closure means attached to same.
Figure 4:
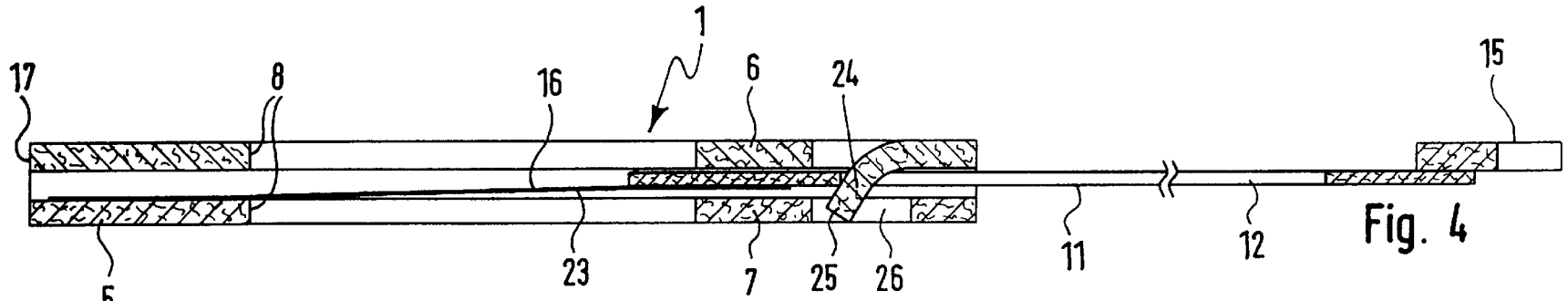
FIG. 4 shows the arrangement of FIG. 2 in a longitudinal section taken on the line IV—IV in the same style as FIG. 3.

On one side of the passage opening 12 and on the slide element 11 a handle portion 15 is arranged projecting from the base 5. The handle portion in the present example being constituted by an additional board member, which is bonded to the rest of the slide element 11. At the end opposite to the handle portion 15 in the length direction 10, i. e. on the other side of the passage opening 12. The slide element 11 is connected with a closure means 16 so that the slide element can pull on the closure means. The arrangement generally being such that by tugging on the handle portion 15 (which pulls on the closure member) by hand the slide element 11 is able to be moved out of an initial position (FIGS. 1 and 3) in which its passage opening 12 is aligned with the passage opening in the base 5, into a closed position (FIGS. 2 and 4). The closure means 16 is moved as well, into a closed position the closure means 16 closes the passage opening 8.

In the initial condition when the filter bag is inserted in the vacuum cleaning equipment the slide element 11 consequently assumes the initial position, in which its passage opening 12 is aligned with the passage opening 8 in the base. Consequently dust laden air may move into the filter bag without hindrance. If on the contrary the handle portion 15 is pulled, when the vacuum cleaner bag is removed from the vacuum cleaner, the closure means 16 is drawn between the two layers of the base over the passage opening 8 so that opening will be closed.

As will appear from the drawing the closure means 16 is received inside the base 5 in the initial condition as well so that it does not project to the outside. The distance between the passage opening 8 and the edge 17, opposite to the handle portion 15, of the base 5 is however smaller than the diameter of the passage opening 8 and accordingly shorter than the somewhat longer displacement, as related to the said diameter, of the slide element 11 on movement thereof into the closed position. In order to ensure that, despite these dimensions, the closure means 16 at the edge 17 does not project from the base and is in fact accommodated within same, the closure means 16 is designed so that it may be elongated in the longitudinal direction 10. For this purpose the closure means 16 is at one end connected with the slide element 11 and at the other end connected with the base 5. On pulling on the handle portion 15 the closure means 16 will be stretched, its end 5 remaining attached to the base 5 (opposite to the sliding element 11).

Figure 5:
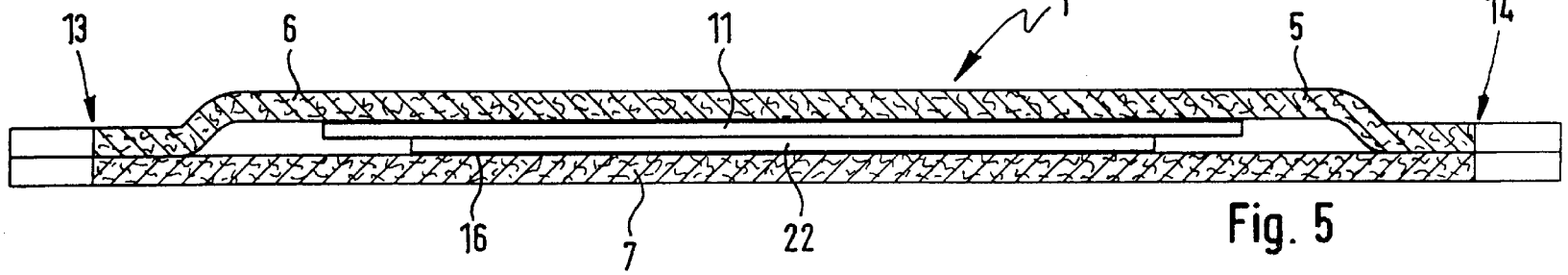
FIG. 5 shows the same connection member in a cross section taken on the line V—V of FIGS. 1 and 2.

The closure means 16 is formed from a plastic material, which in the initial position (FIGS. 1 and 3) is in the form of a strand 22 extending athwart the longitudinal direction 10. In this respect it is a question of an uncured or non-hardened plastic, which on the one hand adheres to the slide element 11 and on the other hand to the base. In the illustrated working embodiment the plastic material strand 22 is located between the bottom base layer 7 and the slide element 11 which is advanced correspondingly far toward the base's edge 17. However it could be arranged between the base layer 6 and the slide element 11. Manufacture of the connection member 1 can be so carried out that the top side of the freely exposed bottom base layer 7 has the plastic material strand applied to it, after which the slide element 11 is placed on top and then the top base layer 6 is applied and is stuck at the two lateral base portions 13 and 14 (see FIGS. 1, 2 and 5) to the bottom base layer.

The plastic material constituting the strand 22 is tacky so that on the one hand it bonds to the slide element 11 and on the other hand to the base 5. It furthermore possesses the properties of a viscous material. On application of a tensile force, the plastic material stretches and thereby undergoes plastic deformation. The plastic material constituting the strand 22 may thus be said to have properties similar to those of chewing gum. This means that on movement of the slide element 11 into the closed position the plastic material is drawn out as a closure diaphragm 23 (FIG. 4) closing the passage opening 8 in the base 5.

The slide element 11 may conveniently comprises a rigid material and more especially board material.

As measured in the transverse direction the closure means 16 has a length at least equal to the diameter of the passage opening 8 with the result that the passage opening 8 is completely covered over in the closed position. The strand 22 of plastic material has a corresponding length.

In order to avoid the danger of the closure diaphragm 23 being torn on pulling out the slide element 11 when the closed position is reached, the slide element 11 should abut on an abutment 24 arranged on the base 5. This abutment can be formed in various different ways. In the embodiment illustrated there is for this purpose at least one stamped out lug 25 on the top base layer 6 adjacent to the passage opening 12 in the slide element 11, and the lug 25 is bent toward the bottom base layer 7 and so extends through the passage opening 12 in the slide element 11. The bottom base layer 7 may have a recess 26 adjacent to the lug 25, for the lug 25 to fit into. The lug 25 may be bonded to the bottom base layer 7.

The lug 25 is arranged on the base 5 in the part facing the handle portion 15 and adjacent to the passage opening 8. In this respect the lug 25 will preferably be directed toward the passage opening 8. In the closed position the edge portion, adjacent to the closure means 16, of the passage opening 12 of the slide element 11 will come into engagement with the lug 25.

What is claimed is:

1. A connection member for a filter bag for vacuum cleaning equipment, comprising a tabular base that comprises two superposed base layers of stiff material which together define a first passage opening extending through both said base layers, and a slide element that defines a second passage opening and that is located between said base layers and that can be longitudinally displaced relative to said base, said slide element having on one side of the second passage opening a handle portion projecting from said base and, on the other side of the second passage opening, said slide element is connected to a closure means in such a manner that the slide element may be moved from an initial position, in which the second passage opening is in registration with the first passage opening into a closed position in which said closure means closes the first passage opening, wherein, said closure means comprises a strand of plastic material that extends transversely in initial state, said plastic material not being fully cured and adapted to plastically deform on the application of a tensile force, said plastic material adhering one a first side to said slide element and on a second side to said base and, on movement of the slide element into the closed position, said plastic material stretches in a longitudinal direction and is drawn out as a diaphragm the first passage opening.

2. The connection member as set forth in claim 1, wherein said strand of plastic material is located between one of said base layers and said slide element.

3. The connection member as set forth in claim 1, wherein said slide element is manufactured of rigid material.

4. The connection member as set forth in claim 1, wherein, in the initial position, said slide element is adapted to engage an abutment provided on said base.

5. The connection member of claim 3, wherein said slide element is formed from board material.

6. The connection member of claim 1, wherein said base layers are formed from board material.

7. A vacuum cleaner bag assembly, said assembly comprising:

a filter bag formed from air permeable filter material, said filter bag being formed to have a wall that defines an opening;

a base unit attached to said filter bag around the filter bag opening, said base unit being shaped to be open around the filter bag opening;

a slide element that is fitted to said base member to be extended away from said base unit along a path of travel parallel to said base unit, said slide element being formed to define a passage opening, wherein said slide element has a first position in which the passage opening is in registration with the filter bag opening and a second position in which the passage opening is spaced away from the filter bag opening; and a layer of plastically deformable material that extends between said base unit and said slide element, wherein said plastically deformable material is attached to said slide element to be deformed upon the extension of said slide element and is position so that, upon extension of said slide element from the first position to the second position, said plastically deformable material is deformed to cover the filter bag opening.

8. The vacuum cleaner bag assembly of claim 7, wherein said slide member is shaped to define a handle located on a first side of said slide member that extends away from said base unit and said plastically deformable material is attached to a second side of said passage opening that is opposite the first side.

9. The vacuum cleaner bag of claim 7, wherein:

said base unit includes two spaced-apart base members that collectively define a space therebetween;

said slide member is disposed in the space between said base members; and said plastically deformable material is affixed to one of said base members.

10. The vacuum cleaner bag assembly of claim 9, wherein said slide member is shaped to define a handle located on a first side of said slide member that extends away from said base unit and said plastically deformable material is attached to a second side of said passage opening that is opposite the first side.

11. The vacuum cleaner bag assembly of claim 9, wherein one of said base members is formed with a lug that extends into the second passage opening and said lug is positioned so that, when said slide member is in the first position, said slide member abuts said lug.

12. The vacuum cleaner bag assembly of claim 9, wherein said base members are bonded together to form said base unit.

13. The vacuum cleaner bag assembly of claim 9, wherein said base members are formed from board material.

14. The vacuum cleaner bag assembly of claim 9, wherein said base members collectively define a through hole that extends through said base unit and that is in registration with the filter bag opening and the through hole intersects the space in which said slide member is seated.

15. The vacuum cleaner bag assembly of claim 7, wherein:

said base unit defines a through hole that extends through said base unit and this is in communication with the filter bag opening and the through hole intersects a space in which said slide member is seated; and when said slide member is in the first position, the passage opening of said slide member is aligned with the through hole of said base unit.

16. The vacuum cleaner bag assembly of claim 7, wherein said base unit is formed from board material.

17. The vacuum cleaner bag assembly of claim 7, wherein said slide member is formed from board material.

18. The vacuum cleaner bag assembly of claim 7, wherein said base unit is formed with a lug that extends into the second passage opening in the slide member and said lug is positioned so that, when said slide member is displaced into the second position, said lug abuts a portion of said slide member so as to prevent further displacement of said slide member.

19. The vacuum cleaner bag assembly of claim 18, wherein said lug is further positioned so that, when said slide member is in the first position, said lug abuts said slide member.

* * * * *